United States Patent [19]

Nishimura

[11] Patent Number: 4,526,304

[45] Date of Patent: Jul. 2, 1985

[54] APPARATUS FOR RAPID CHANGING OF NOZZLES

[75] Inventor: Takahiro Nishimura, Fukushima, Japan

[73] Assignee: Allied Corporation, Morris Township, Morris County, N.J.

[21] Appl. No.: 495,282

[22] Filed: May 16, 1983

[51] Int. Cl.[3] ..... B22D 35/00; B22D 37/00

[52] U.S. Cl. ..... 222/607; 222/600

[58] Field of Search ..... 222/591, 600, 606, 607, 222/566, 567, 526, 533; 164/337, 437

[56] References Cited

U.S. PATENT DOCUMENTS 4,079,869 3/1978 Meier et al. ..... 222/600

FOREIGN PATENT DOCUMENTS 124018 8/1979 Japan .
65766 6/1981 Japan .

*Primary Examiner*—Joseph J. Rolla
*Assistant Examiner*—Louise S. Heim
*Attorney, Agent, or Firm*—Jay P. Friedenson

[57] ABSTRACT

A novel apparatus for rapidly changing a submerged nozzle used to introduce molten steel from a ladle to a tundish or from a tundish to a mold. A submerged nozzle hanger having a submerged nozzle seating member at the free end thereof is raised and lowered while being rotated about a rotary sleeve to carry a submerged nozzle seated at said free end back and forth between a position at which the nozzle is mated with a teeming nozzle provided on the ladle or tundish, and a position at which submerged nozzles can be exchanged.

1 Claim, 6 Drawing Figures

5
10
23
a
14
24
17
17a
II 21
8
22
23
18
10
II
17
24

APPARATUS FOR RAPID CHANGING OF NOZZLES

BACKGROUND OF THE INVENTION

1. Field of the Invention

This invention relates to an apparatus for changing a nozzle such as a long nozzle or submerged nozzle fitted to a teeming nozzle provided on the bottom of a vessel for the casting of molten steel. More particularly, the invention relates to an apparatus which facilitates the operation for changing these nozzles.

2. Description of the Prior Art

In the continuous casting of steel or the casting of steel ingot, molten steel is charged from a ladle into a tundish or from a tundish into a mold. It is common practice to introduce the molten steel through a submerged nozzle disposed between the ladle and tundish or between the tundish and mold in order to improve the quality of the steel. Since the nozzle is constantly submerged in the molten steel during the charging operation, nozzle lifetime is short and replacement is required with some frequency.

Owing to the nature of the casting process, the replacement of the submerged nozzle must be performed in a rapid manner. It is also desirable from the standpoint of worker well-being that the replacement work be as light as possible in view of the high temperature of the immediate environment. Apparatus of various configurations have been disclosed to attain these objects, but none of them are fully satisfactory in terms of structural simplicity and handling ease.

SUMMARY OF THE INVENTION

Accordingly, an object of the present invention is to provide an apparatus for rapid nozzle exchange which is structurally simpler than prior-art arrangements and easy to handle and use.

Another object of the present invention is to provide an apparatus for rapid nozzle exchange wherein nozzles can be changed either manually or through automation.

According to the present invention, the foregoing objects are attained by providing an apparatus for rapid nozzle exchange which includes a rotary sleeve mounted adjacent to a teeming nozzle provided on the bottom of a molten steel vessel, a submerged nozzle hanger having a base portion pivotally supported on the rotary sleeve and a submerged nozzle seating member provided at the free or unsupported end thereof, and a bayonet or screw mechanism provided between the rotary sleeve and the inner peripheral surface of the base portion for raising and lowering the nozzle hanger relative to the sleeve and for swinging the hanger back and forth as the sleeve is rotated in one direction and then the other, whereby the hanger carries an old submerged nozzle from an operating position to a position where the nozzle is exchanged for a new one, and then carries the new submerged nozzle from the exchange position to the operating position.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

Figures 1, 3:
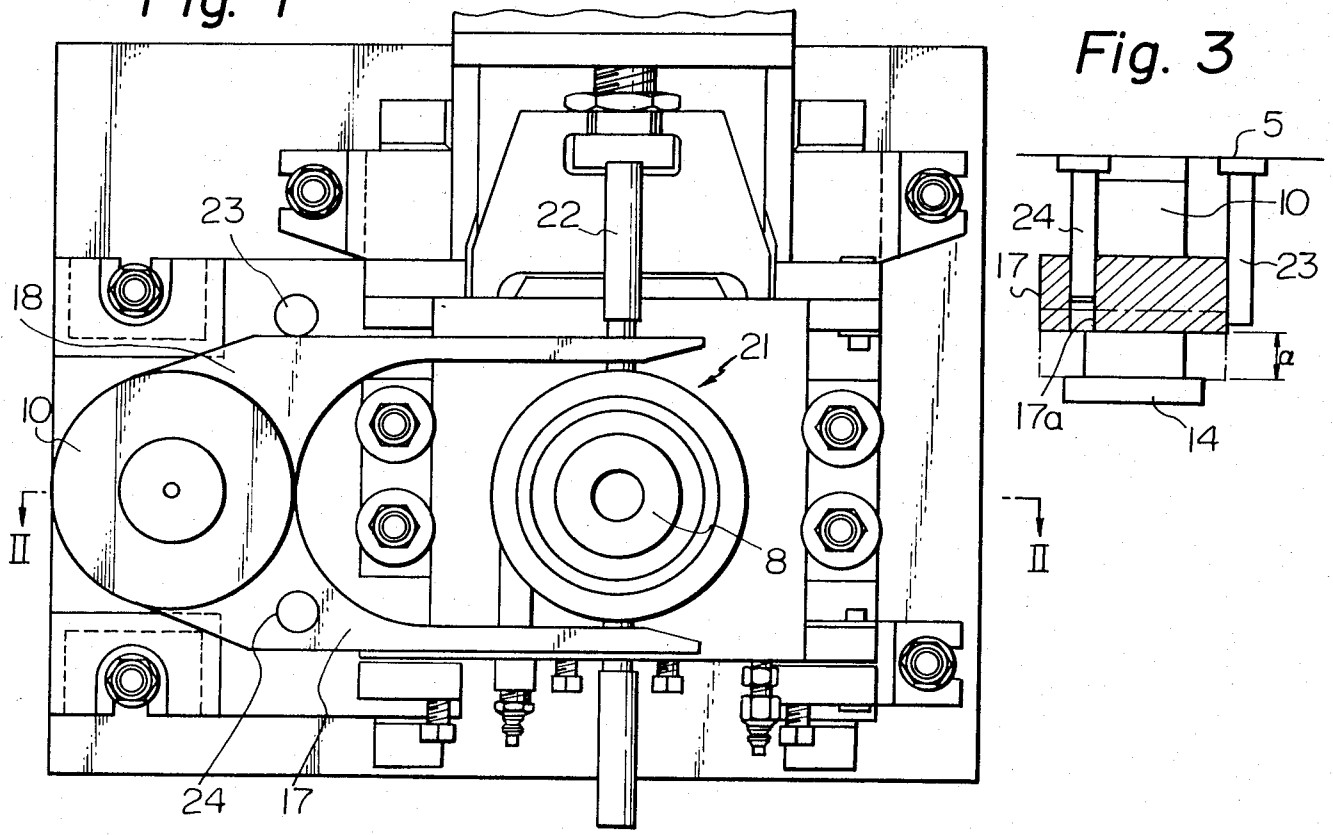
FIG. 1 is a bottom view of a sliding nozzle arrangement having an apparatus for rapid nozzle exchange embodying the present invention.
FIG. 3 is a schematic view useful in describing the operation of stopper rods for stopping and positioning a submerged nozzle hanger shown in FIGS. 1 and 2.
Figure 2:
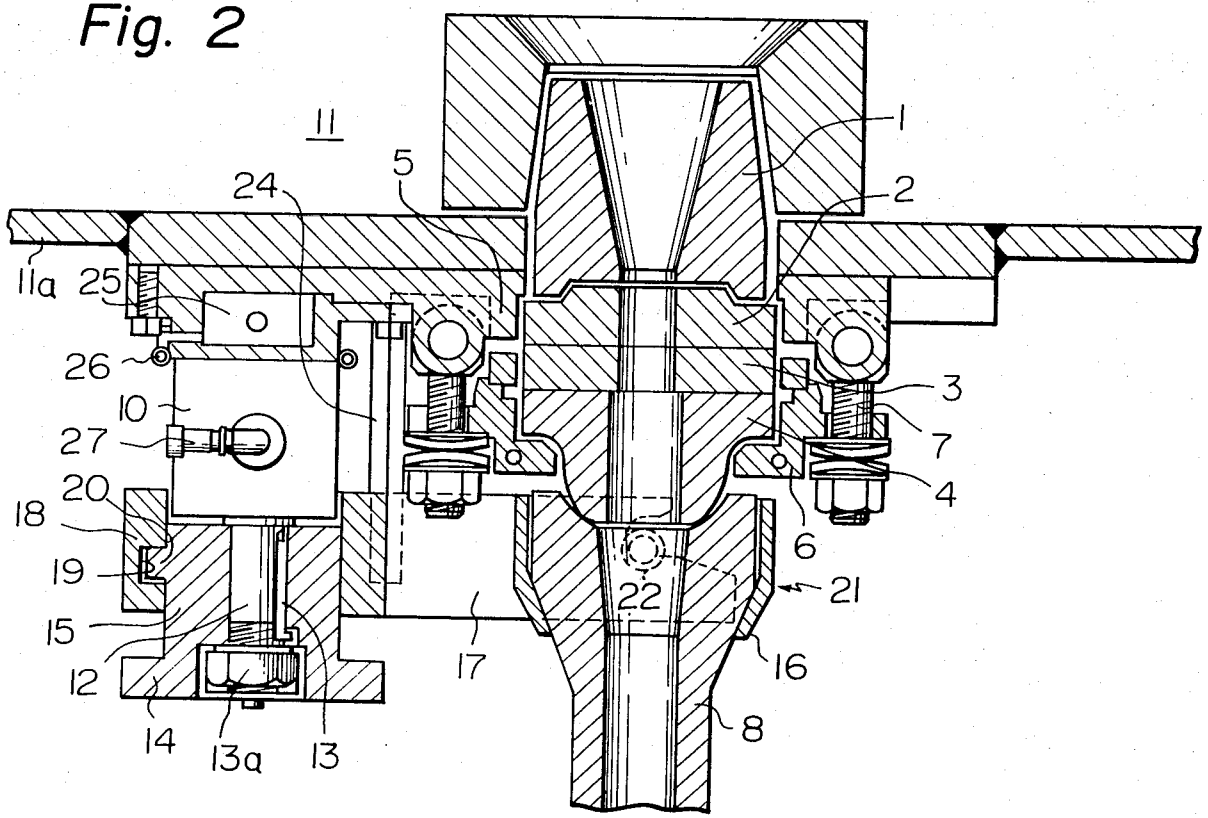
FIG. 2 is a sectional view taken along line II—II of FIG. 1.

Reference will first be made to FIGS. 1 and 2 to describe an embodiment of an apparatus for the rapid changing of nozzles according to the present invention. In the illustrated embodiment, the apparatus is provided on a sliding nozzle arrangement as is customarily employed in a casting process.

The sliding nozzle arrangement is of the known triple plate-type provided on a tundish, and includes an upper nozzle 1, a fixed upper plate 2, a sliding middle plate 3, a fixed lower plate 4, an upper metal frame 5, a lower metal frame 6 connected to the upper metal frame 5 by tightened bolts 7, and a submerged nozzle 8. The upper nozzle 1 and plates 2, 3, 4 together form a teeming nozzle which is opened and closed by sliding the sliding plate 3.

Numeral 11 denotes a molten steel vessel having a bottom 11*a*. A rotating device, specifically a hydraulic motor 10 in the illustrated embodiment, is attached to the underside of the vessel bottom 11*a* at a position spaced a prescribed distance from the central axis of the teeming nozzle. The hydraulic motor 10 has a downwardly extending output shaft 12 lying substantially parallel to the central axis of the teeming nozzle. A rotary sleeve 15 is fixedly secured to the output shaft 12 by a key 13 and nut 13*a*, and includes a flange 14 at its lower end to prevent the fall of a submerged nozzle hanger 17. The latter includes a base portion 18 pivotally supported on the rotary sleeve 15, and has a submerged nozzle seating member 16 at its free or swingable end. A bayonet mechanism for raising and lowering the submerged nozzle hanger 17 relative to the cylindrical member 15 as the latter rotates is provided between the cylindrical member 15 and the inner peripheral surface of the base portion 18 at the supported end of the hanger 17. The bayonet mechanism comprises a spiral channel 19 formed in the inner peripheral surface of the hanger base portion 18, and a projection 20 formed on the outer peripheral surface of the cylindrical body 15 so as to fit in the spiral channel 19. It should be noted that a screw mechanism may be adopted as an alternative to the bayonet configuration for raising and lowering the submerged nozzle hanger 17.

Various structural configurations are possible for the submerged nozzle seating member 16. In the illustrated embodiment, the seating member 16 includes a substantially funnel-shaped casing 21 having converging side walls at its lower end for mounting the submerged nozzle 8, and an extendible arm 22 attached to both sides of the casing 21. The extendible arm 22 has a base portion received in a trunnion provided on the freely swingable end of the submerged nozzle hanger 17.

Stopper rods 23, 24, the former being of somewhat longer length, have their upper ends implanted in the stationary upper frame 5 and extend downwardly to the submerged nozzle hanger 17. The latter has an elongated hole 17*a* formed in the upper side thereof at a position where it will receive the stopper rod 24 when the hanger 17 brings the submerged nozzle 8 to an operating position, as will be described below. As will also be described later, the stopper rods 23, 24 and the hole 17*a* serve to temporarily prevent the swinging motion of the nozzle hanger 17 and to position the hanger in the attitude shown in the drawing. In the preferred embodiment, the stopper rods 23, 24 cooperate with the above-described bayonet mechanism in the raising and lowering of the submerged nozzle hanger 17 relative to the rotating cylindrical member 15.

An air chamber 25 is provided for supplying cooling air to air piping 26 for the purpose of cooling the hydraulic motor 10. Piping for supplying hydraulic pressure is indicated at 27.

Described next will be the operation through which the apparatus of the invention effects a rapid exchange of submerged nozzles in the above-described sliding nozzle arrangement.

FIG. 2 shows the submerged nozzle 8 mounted in place for cooperation with the lower plate 4 of the teeming nozzle. Let us now assume that the submerged nozzle 8 has reached the end of its useful life and is to be replaced by a new submerged nozzle. The first step in making the change is to actuate the hydraulic motor 10 to rotate the rotary sleeve 15 in a direction that will lower the submerged nozzle hanger 17. As shown in FIG. 3, swinging motion of the hanger 17 about the rotary sleeve 15 is prevented at this time by means of the stopper rod 24 which mates with the hole 17*a*, so that the hanger 17 will be lowered through the action of the bayonet mechanism as the rotary sleeve 15 rotates. When the hanger 17 descends a distance $\alpha$ shown in FIG. 3, the hole 17*a* in the upper side thereof will completely disengage from the stopper rod 24. As a result, with continued operation of the hydraulic motor 10, the nozzle hanger 17 rotates in unison with the rotary sleeve 15 until it is swung to a prescribed location where the old submerged nozzle 8 is exchanged for a new submerged nozzle. Following the exchange, the hydraulic motor 10 is rotated in the reverse direction, whereby the hanger 17 carrying the new submerged nozzle 8 is swung back toward the teeming nozzle arrangement owing to rotation of the rotary sleeve 15. In returning to the position beneath the lower plate 4, the nozzle hanger 17 clears the stopper rod 24 and then abuts against the stopper rod 23 of longer length, thereby being brought to a stop, as depicted in FIG. 3. Thus the stopper rod 23 serves to align the axis of the submerged nozzle 8 with the axis of the teeming nozzle. Meanwhile, the hydraulic motor 10 continues to rotate the rotary sleeve 15 in the reverse direction to raise the submerged nozzle hanger 17 along the sleeve to the operating position where the submerged nozzle 8 is brought into fitting engagement with the lower plate 4 of the teeming nozzle, the stopper rod 24 penetrating the hole 17*a* as the hanger 17 is raised.

It should be noted that the mechanism for stopping the swinging motion of the hanger 17 is not limited to the illustrated arrangement of the stopper rods 23, 24 and hole 17*a*. An alternative would be to provide the hanger 17 with a rod for preventing rotation thereof, and provide the fixed upper frame 5 with a longitudinal bore for receiving the rod, and with a separate stopper rod. The latter can be arranged to extend in a lateral direction.

Figure 4:
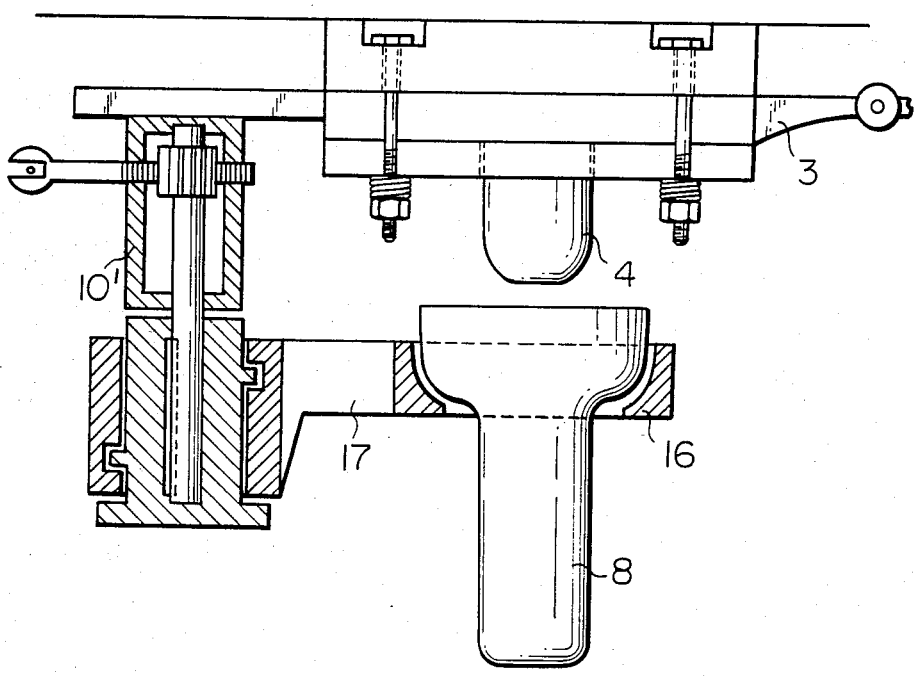
FIG. 4 is a side view, partially in section, illustrating another embodiment of the apparatus for rapid nozzle exchange according to the present invention.
Figure 5:
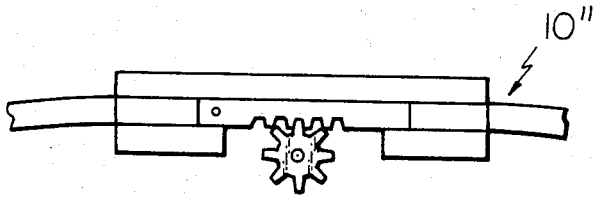
FIG. 5 is a view showing an example of a rotating device capable of being applied to the apparatus of the present invention.

The rotating device in the preferred embodiment of FIGS. 1 and 2 comprises the hydraulic motor 10. It is also possible to employ an air motor as the rotating device, a fluid pressure cylinder 10' as illustrated in FIG. 4, or a reciprocating plunger 10" as shown in FIG. 5. Note that FIG. 4 illustrates a sliding nozzle arrangement of double plate type.

Figure 6:
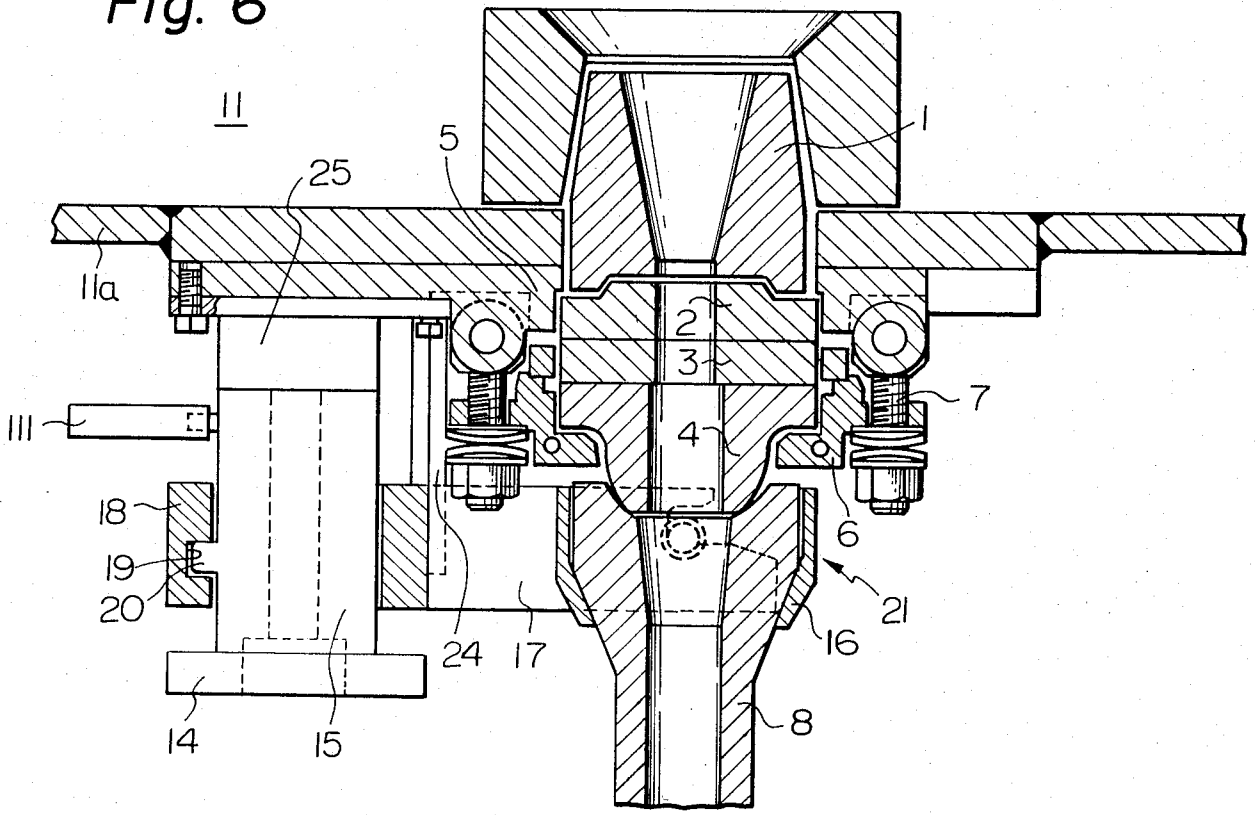
FIG. 6 is a sectional elevational view illustrating another embodiment of an apparatus for rapid nozzle exchange according to the present invention.

FIG. 6 illustrates another embodiment of the present invention. Unlike the above described embodiments which rely upon a power-driven rotating device such as the hydraulic motor 10 for rotating the rotary sleeve 15, the present embodiment employs manual means for rotation and for the attendant mounting and demounting of the submerged nozzle. This is accomplished by providing a rotary sleeve 115 and a detachable handle 111 which is attached to the rotary sleeve 115 when required to rotate the same manually. All other elements shown in FIG. 6 operate as described above in connection with FIGS. 1, 2 and 3.

In accordance with the present invention as described and illustrated hereinabove, the apparatus for rapidly changing nozzles is structurally simple and is operated merely by swinging the nozzle hanger between the operating position and exchange position. The addition of the rotating device makes it possible to automate this operation for even greater handling ease.

It should be noted that the invention is not limited to submerged nozzles alone but can be similarly applied to the rapid exchange of long nozzles used in charging molten steel from a ladle into a tundish.

As many apparently widely different embodiments of the present invention can be made without departing from the spirit and scope thereof, it is to be understood that the invention is not limited to the specific embodiments thereof except as defined in the appended claims.

What is claimed is:

1. An apparatus for rapidly changing a submerged nozzle, comprising:

a rotary sleeve mounted adjacent to a teeming nozzle provided on a bottom portion of a ladle or tundish;

a submerged nozzle hanger having a base portion at one end thereof pivotally supported on said rotary sleeve and a submerged nozzle seating member provided at the free distal end thereof;

a submerged nozzle hanger raising and lowering mechanism which, when said submerged nozzle hanger is rotated about the axis of said rotary sleeve, is operable in response to rotation in a first direction for raising said submerged nozzle hanger from a first position at which the submerged nozzle is exchanged to a second position at which the submerged nozzle is mated with the teeming nozzle, and is operable in response to rotation in a second direction for lowering said submerged nozzle hanger from said second position to said first position; and a positioning mechanism adjacent to the teeming nozzle for positioning said submerged nozzle hanger which positioning mechanism comprises first and second stopper rods implanted in a stationary frame adjacent to the teeming nozzle, said first stopper rod being of smaller length than said second stopper rod, and wherein said submerged nozzle hanger includes a bore in the side thereof facing said stopper rods, said submerged nozzle hanger coming into abutting contact with said second stopper rod in being raised by rotation in said first direction, whereby rotation of said hanger is stopped, said submerged nozzle hanger being subsequently raised along said second stopper rod to mate said bore with said first stopper rod, thereby positioning said submerged nozzle hanger.

* * * * *